US006049295A

United States Patent [19]

Sato

[11] Patent Number: 6,049,295

[45] Date of Patent: Apr. 11, 2000

[54] METHOD AND SYSTEM FOR AVOIDING A COLLISION AT AN INTERSECTION AND A RECORDING MEDIUM STORING PROGRAMS PERFORMING SUCH A METHOD

[75] Inventor: Jun Sato, Kawasaki, Japan

[73] Assignee: Fujitsu Limited, Kawasaki, Japan

[21] Appl. No.: 09/127,608

[22] Filed: Jul. 31, 1998

[30] Foreign Application Priority Data

Dec. 5, 1997 [JP] Japan ..... 9-335986

[51] Int. Cl.[7] ..... G08G 1/00

[52] U.S. Cl. ..... 340/928; 340/904; 340/907; 340/918; 340/919; 235/380; 235/384

[58] Field of Search ..... 340/436, 928, 340/916, 917, 906, 902, 907, 909, 915, 905, 918, 919, 904; 235/380, 384, 379

[56] References Cited

U.S. PATENT DOCUMENTS

| | | | |
|---|---|---|---|
| 3,739,332 | 6/1973 | Martinez | 340/37 |
| 3,774,147 | 11/1973 | Hendricks | 340/35 |
| 4,025,922 | 5/1977 | Trawick, III | 343/6.5 |
| 4,573,049 | 2/1986 | Obeck | 340/924 |
| 4,727,371 | 2/1988 | Wulkowicz | 340/917 |
| 4,843,337 | 6/1989 | Conn, Jr. et al. | 340/906 |
| 5,214,793 | 5/1993 | Conway et al. | 455/49.1 |
| 5,424,727 | 6/1995 | Shieh | 340/928 |
| 5,757,285 | 5/1995 | Grabow et al. | 340/928 |
| 5,777,565 | 7/1998 | Hayashi et al. | 340/928 |
| 5,784,006 | 7/1998 | Hochstein | 340/905 |
| 5,847,661 | 12/1998 | Ricci | 340/902 |

*Primary Examiner*—Nina Tong
*Assistant Examiner*—Tai T. Nguyen
*Attorney, Agent, or Firm*—Staas & Halsey

[57] ABSTRACT

Vehicles are prevented from colliding with each other at an intersection provided with no traffic light or having an obstructed view. A road-side apparatus is provided in the intersection and a on-board apparatus is provided on a vehicle. The on-board apparatus communicable with the road-side apparatus via a wireless packet communication. An empty wireless packet is periodically transmitted from the road-side apparatus in each of directions corresponding to roads extending from the intersection. The on-board apparatus returns a returning wireless packet to the road-side apparatus by providing a vehicle ID code to the empty wireless packet. A wireless packet including the vehicle ID code of one of the vehicle is transmitted to each of the directions corresponding to the roads when the one of the vehicle is determined to be provided with permission for entering the intersection. The onboard apparatus determines whether or not the vehicle ID code included in the received returning wireless packet matches its own vehicle ID code. An instruction of permission for entering the intersection is provided to a driver of the vehicle when the vehicle ID code included in the received returning wireless packet matches the vehicle ID code of the vehicle.

29 Claims, 6 Drawing Sheets

METHOD AND SYSTEM FOR AVOIDING A COLLISION AT AN INTERSECTION AND A RECORDING MEDIUM STORING PROGRAMS PERFORMING SUCH A METHOD

BACKGROUND OF THE INVENTION

1. Field of the Invention

The present invention generally relates to a method and system for avoiding a collision at an intersection and, more particularly, to a method and system for avoiding a collision of vehicles at an intersection having an obstructed view.

More specifically, the present invention relates to a method and system for avoiding a vehicle collision at an intersection having no traffic signal or having an obstructed view so that one of vehicles entering the intersection is permitted to pass the intersection first by giving a priority to the one of the vehicles.

2. Description of the Related Art

Conventionally, when a plurality of vehicles enter an intersection having an obstructed view substantially at the same time, a determination as to which vehicle has a priority to pass the intersection is entrusted to drivers of the vehicles. In such a case, the drivers of the vehicles visually recognize each other, and one of the drivers may give a priority to the other or one of the vehicles entering the intersection first is given a priority to passes the intersection first.

However, when a plurality of vehicles enters an intersection provided with no traffic signal lights substantially at the same time, each of the vehicles may attempt to pass the intersection without giving way to others. In such a case, the vehicles may not reduce their speed near the intersection, which may result in a collision at the intersection. Additionally, it is difficult to visually recognize other vehicles at an intersection having an obstructed view. In this case, a collision may occur even when vehicles enter the intersection at a reduced speed.

SUMMARY OF THE INVENTION

It is a general object of the present invention to provide an improved and useful method and system for avoiding a collision at an intersection in which the above-mentioned problems are eliminated.

A more specific object of the present invention is to provide a method and system for avoiding vehicles from colliding with each other at an intersection provided with no traffic light or having an obstructed view.

Another object of the present invention is to provide a recording medium storing programs for performing a method for avoiding a collision at an intersection.

A further object of the invention is to provide an apparatus provided to an intersection to prevent a collision of vehicles by providing an instruction to each of the vehicles.

In order to achieve the above-mentioned objects, there is provided according to one aspect of the present invention a method for avoiding a collision at an intersection, the method using a road-side apparatus provided in the intersection and an on-board apparatus provided on a vehicle, the on-board apparatus communicable with the road-side apparatus via a wireless packet communication, the road-side apparatus being located at a position where communications can be performed in any one of directions corresponding to roads extending from the intersection, the method comprising the steps of:

periodically transmitting a wireless packet from the road-side apparatus in each of the directions corresponding to the roads extending from the intersection;

receiving the wireless packet by the on-board apparatus and returning the wireless packet from the on-board apparatus to the road-side apparatus as a returning wireless packet by providing a vehicle ID code to the wireless packet, the vehicle ID code being unique to each vehicle;

receiving the returning wireless packet by the road-side apparatus and determining whether the vehicle is to be provided with permission for entering the intersection;

transmitting the returning wireless packet from the road-side apparatus in each of the directions corresponding to the roads extending from the intersection when the vehicle is determined to be provided with permission for entering the intersection;

receiving the returning wireless packet by the on-board apparatus and determining whether or not the vehicle ID code included in the received returning wireless packet matches the vehicle ID code of the vehicle; and providing an instruction of permission for entering the intersection to a driver of the vehicle when the vehicle ID code included in the received returning wireless packet matches the vehicle ID code of the vehicle and providing an instruction of non-permission for entering the intersection to the driver of the vehicle when the vehicle ID code included in the received returning wireless packet is different from the vehicle ID code of the vehicle.

According to the above-mentioned invention, since the wireless packet including the same vehicle ID code is transmitted in each of the directions corresponding to the roads, the only one vehicle provided with the vehicle ID code determines that the vehicle ID code included in the wireless packet matches its own vehicle ID code. Thus, the only one vehicle is provided with permission for entering the intersection and other vehicles is provided with non-permission for entering the intersection.

Additionally, the method according to the present invention may further comprise the step of:

eliminating the vehicle ID code from the returning wireless packet prior to being transmitted from the road-side apparatus when the road-side vehicle cannot normally receive the wireless packet returned from the on-board apparatus so that the on-board apparatus determines that permission for entering the intersection is not provided to the vehicle.

Accordingly, since non-permission for entering the intersection is provided to all vehicles moving toward the intersection when the returning wireless packet cannot be normally received due to a communication problem such as a congestion, highly reliable safeness can be maintained.

Additionally, the step for providing an instruction may include the step for displaying the instruction on the road-side apparatus. Accordingly, the road-side apparatus can serve as a traffic signal which effectively prevents a collision at the intersection.

Additionally, the wireless packet communication between the road-side apparatus and the on-board apparatus may be performed in accordance with a spread spectrum communication in a code division multiple access method.

Additionally, there is provided according to another aspect of the present invention an intersection collision avoiding system for avoiding a collision at an intersection, comprising:

a road-side apparatus provided in the intersection and located at a position where communications can be performed in any one of directions corresponding to roads extending from the intersection; and a on-board apparatus provided on a vehicle, the on-board apparatus communicable with the road-side apparatus via a wireless packet communication, wherein the road-side apparatus comprises:

a transmitting unit transmitting a wireless packet in each of the directions corresponding to the roads extending from the intersection; and a receiving unit receiving a returning wireless packet transmitted by the on-board apparatus, and wherein the on-board apparatus comprises:

a packet producing unit producing the returning wireless packet, when the wireless packet transmitted by the road-side apparatus is received, by providing a vehicle ID code to the wireless packet received from the road-side apparatus, the vehicle ID code being unique to each vehicle;

a transmitting unit transmitting the returning wireless packet produced by the packet producing unit; and a receiving unit receiving a wireless packet transmitted by the road-side apparatus.

According to the above-mentioned invention, since the wireless packet including the same vehicle ID code is transmitted in each of the directions corresponding to the roads, the only one vehicle provided with the vehicle ID code determines that the vehicle ID code included in the wireless packet matches its own vehicle ID code. Thus, the only one vehicle is provided with permission for entering the intersection and other vehicles is provided with non-permission for entering the intersection.

In the intersection collision avoiding system according to the present invention, the on-board apparatus may further comprise:

a control unit for determining whether or not the vehicle ID code included in the returning wireless packet received by the road-side apparatus matches the vehicle ID code of the vehicle; and a display unit providing an instruction of permission for entering the intersection to a driver of the vehicle when the vehicle ID code included in the received returning wireless packet matches the vehicle ID code of the vehicle and providing an instruction of non-permission for entering the intersection to the driver of the vehicle when the vehicle ID code included in the received returning wireless packet is different from the vehicle ID code of the vehicle.

According to the above-mentioned invention, since the wireless packet including the same vehicle ID code is transmitted in each of the directions corresponding to the roads, the only one vehicle provided with the vehicle ID code determines that the vehicle ID code included in the wireless packet matches its own vehicle ID code. Thus, the only one vehicle is provided with permission for entering the intersection and other vehicles is provided with non-permission for entering the intersection.

Additionally, in the intersection collision avoiding system according to the present invention, the road-side apparatus may further comprise:

a packet producing unit producing the wireless packet to be transmitted to the on-board apparatus by eliminating the vehicle ID code from the returning wireless packet when the road-side apparatus cannot normally receive the returning wireless packet so that the on-board apparatus determines that permission for entering the intersection is not provided to the vehicle.

Accordingly, non-permission for entering the intersection is provided to all vehicles moving toward the intersection when the returning wireless packet cannot be normally received due to a communication problem such as a congestion, and thus highly reliable safeness can be maintained.

Additionally, in the intersection collision avoiding system according to the present invention, the road-side apparatus may further comprise:

a control unit determining whether or not the vehicle is to be provided with permission for entering the intersection based on a timing of reception of the returning wireless packet; and a display unit displaying a sign representing the permission for entering the intersection toward one of the roads from which the vehicle is entering the intersection when the vehicle is determined to be provided with the permission, and displaying a sign representing non-permission for entering the intersection toward the rest of the roads.

Accordingly, the road-side apparatus can serve as a traffic signal which effectively prevents a collision at the intersection.

Additionally, in the intersection collision avoiding system according to the present invention, the wireless packet communication between the road-side apparatus and the on-board apparatus may be performed in accordance with a spread spectrum communication in a code division multiple access method.

Additionally, there is provided according to another aspect of the present invention a recording medium storing program code for implementing a method for avoiding a collision at an intersection, the method using a road-side apparatus provided in the intersection and a on-board apparatus provided on a vehicle, the on-board apparatus communicable with the road-side apparatus via a wireless packet communication, the road-side apparatus being located at a position where communications can be performed in any one of directions corresponding to roads extending from the intersection, comprising:

program code means for periodically transmitting a wireless packet from the road-side apparatus in each of the directions corresponding to the roads extending from the intersection;

program code means for receiving the wireless packet by the on-board apparatus and returning the wireless packet from the on-board apparatus to the road-side apparatus as a returning wireless packet by providing a vehicle ID code to the wireless packet, the vehicle ID code being unique to each vehicle;

program code means for receiving the returning wireless packet by the road-side apparatus and determining whether the vehicle is to be provided with permission for entering the intersection;

program code means for transmitting the returning wireless packet from the road-side apparatus to each of the directions corresponding to the roads extending from the intersection when the vehicle is determined to be provided with permission for entering the intersection;

program code means for receiving the returning wireless packet by the on-board apparatus and determining whether or not the vehicle ID code included in the received returning wireless packet matches the vehicle ID code of the vehicle; and program code means for providing an instruction of permission for entering the intersection to a driver of the vehicle when the vehicle ID code included in the received returning wireless packet matches the vehicle ID code of the vehicle and providing an instruction of non-permission for entering the intersection to the driver of the vehicle when the vehicle ID code included in the received returning wireless packet is different from the vehicle ID code of the vehicle.

The recording medium according to the present invention may further comprise:

program code means for eliminating the vehicle ID code from the returning wireless packet prior to transmission from the road-side apparatus when the road-side vehicle cannot normally receive the wireless packet returned from the on-board apparatus so that the on-board apparatus determines that permission for entering the intersection is not provided to the vehicle.

Additionally, the program code means for providing an instruction may include program code means for displaying the instruction on the road-side apparatus.

There is provided according to another aspect of the present invention an apparatus for avoiding a collision of vehicles at an intersection of a plurality of paths, the apparatus comprising:

receiving means for receiving data from vehicles moving along the plurality of paths; and permission notification means for sending a notification of one of permission and non-permission for entering the intersection to each of the vehicles based on the data received by the receiving means.

Other objects, features and advantages of the present invention will become more apparent from the following detailed description when read in conjunction with the accompanying drawings.

DETAILED DESCRIPTION OF THE PREFERRED EMBODIMENTS

Figure 1:
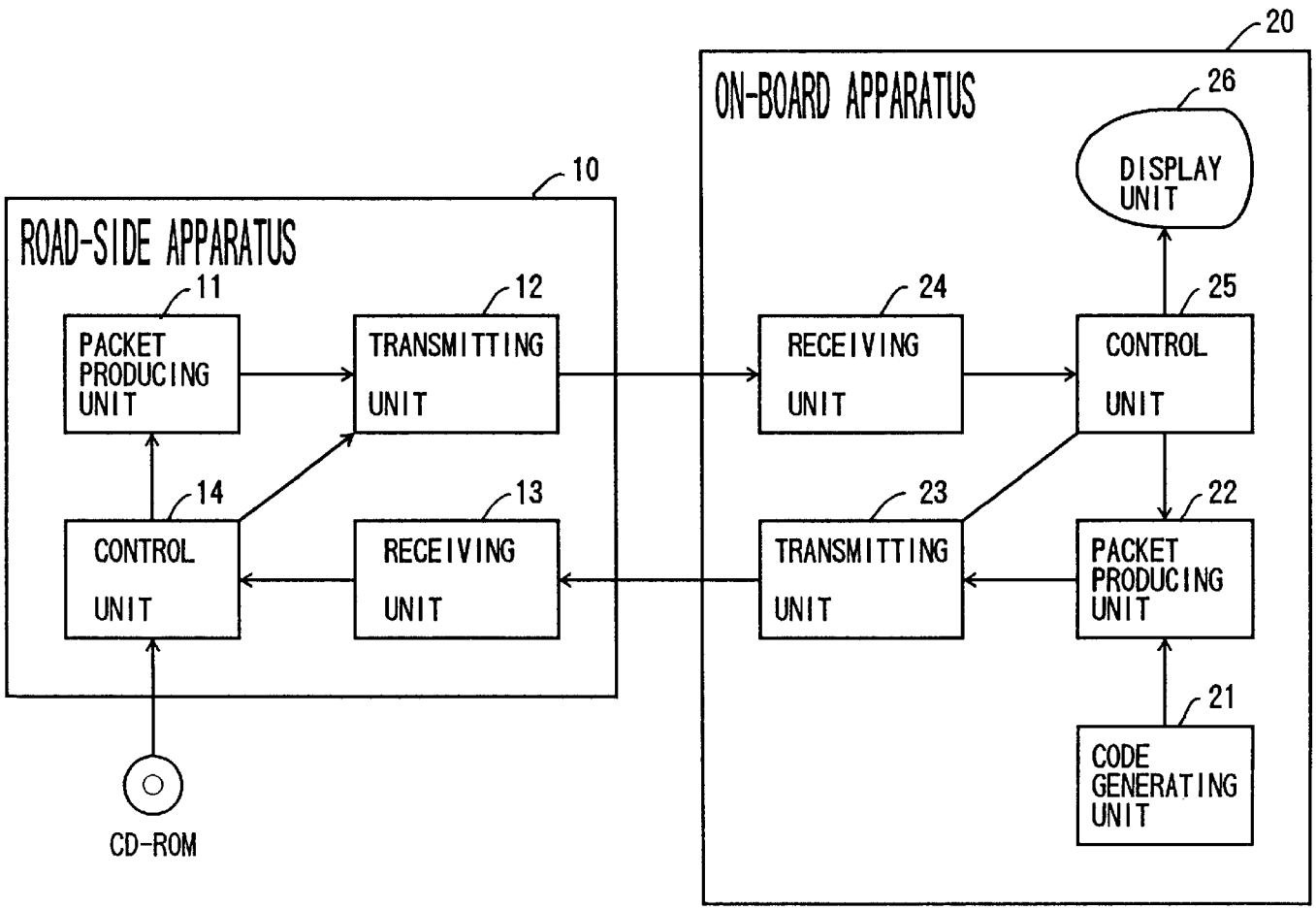
FIG. 1 is a block diagram of an intersection collision avoiding system according to a first embodiment of the present invention.

A description will now be given of a first embodiment of the present invention. FIG. 1 is a block diagram of a system for avoiding a collision of vehicles at an intersection (hereinafter referred to as an intersection collision avoiding system).

The intersection collision avoiding system shown in FIG. 1 comprises a road-side apparatus 10 and a on-board apparatus 20. The road-side apparatus 10 has a wireless communication function, and is installed at a position where a transmission and a reception of signals can be performed in any direction of an intersection. The on-board apparatus 20 is provided on a vehicle, and is communicable with the road-side apparatus 10. A medium of the communication between the road-side apparatus 10 and the on-board apparatus 20 can be any wireless communication medium such as radio frequency, infrared or ultrasonic. As for a selection of the communication medium, a consideration should be made for a limitation of a communicable distance so as to prevent interference between adjacent systems. Size and shape of the communication apparatus may also be important.

As for the communication system between the road-side apparatus 10 and the on-board apparatus 20, a multiple access wireless communication system such as a frequency division multiple access (FDMA), a time division multiple access (TDMA) or a code division multiple access (CDMA) can be used. In the present embodiment, the code division multiple access (CDMA) is used. In the CDMA, a wireless packet transmitted from other intersections can be discriminated by using a spread spectrum communication system and changing a PN code used for spreading between each road-side apparatus 10.

The road-side apparatus 10 comprises, as shown in FIG. 1, a packet producing unit 11, a transmitting unit 12, a receiving unit 13 and a control unit 14. The packet producing unit 11 produces a wireless packet to be transmitted to the on-board apparatus 20. The transmitting unit 12 transmits the wireless packet to the on-board apparatus 20. The receiving unit 13 receives a wireless packet from the on-board apparatus 20. The control unit 14 controls operations of the above-mentioned units.

The on-board apparatus 20 comprises, as shown in FIG. 1, a code generating unit 21, a packet producing unit 22, a transmitting unit 23, a receiving unit 24, a control unit 25 and a display unit 26. The code generating unit 21 generates a code which is transmitted to the road-side apparatus 10 by a wireless packet. The packet producing unit 22 produces a wireless packet including the code generated by the code generating unit 22. The transmitting unit 23 transmits the wireless packet produced by the packet producing unit 22. The receiving unit 24 receives the wireless packet transmitted by the road-side apparatus 10. The control unit 25 controls operations of each unit provided in the on-board apparatus 20. The display unit 26 provides an instruction to a driver whether or not the vehicle is permitted to enter an intersection by displaying the instruction.

Figure 2:
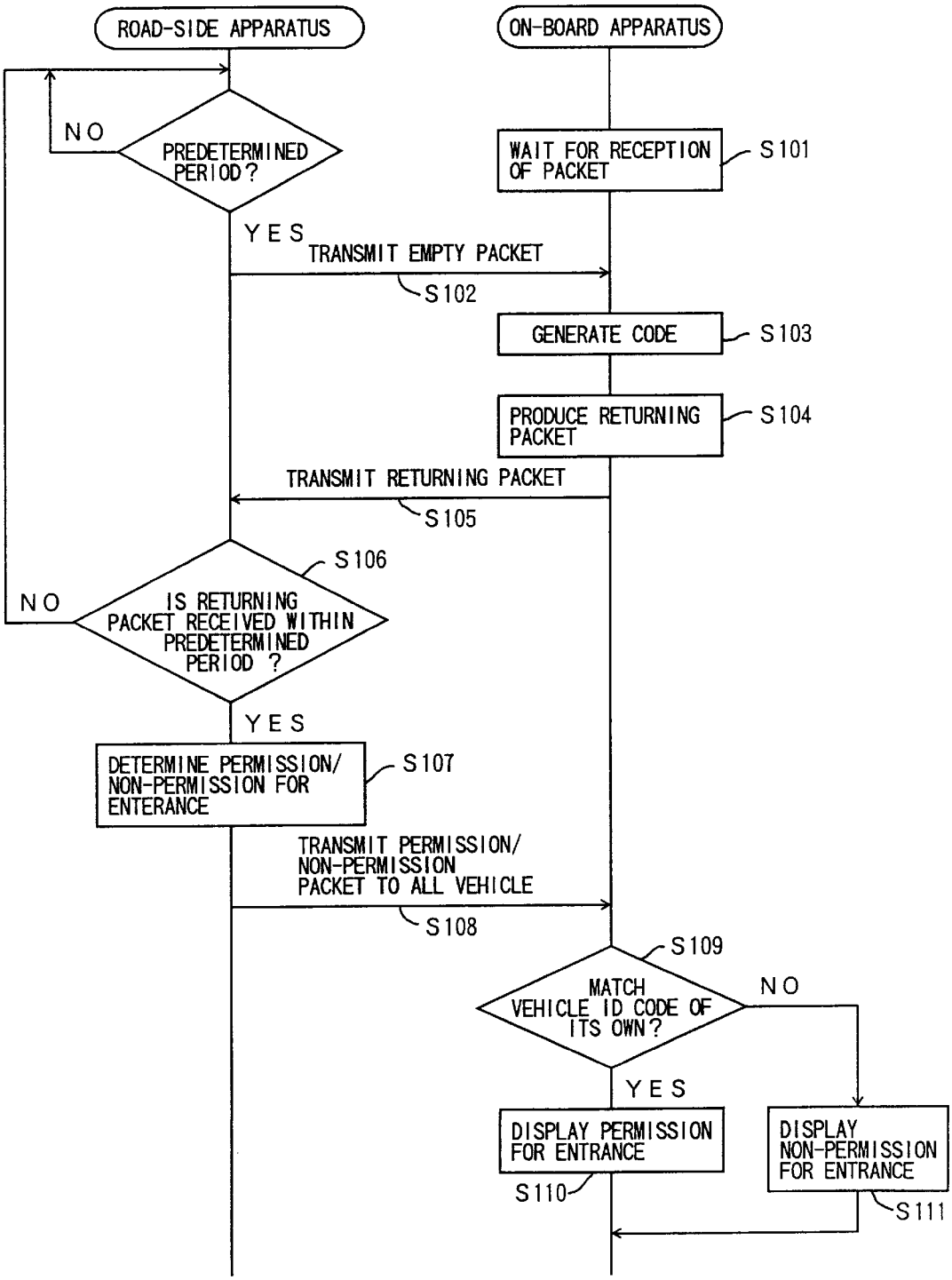
FIG. 2 is a sequence chart of an operation performed by the intersection collision avoiding system shown in FIG. 1.

A description will now be given of an operation of the intersection collision avoiding system according to the first embodiment of the present invention. FIG. 2 is a sequence chart of the operation performed by the intersection collision avoiding system shown in FIG. 1.

In step S101, the on-board apparatus 20 waits for reception of a wireless packet transmitted by the road-side apparatus 10. On the other hand, the road-side apparatus 10 determines whether or not a predetermined period has been passed. If it is determined that the predetermined period has been passed, the road-side apparatus 10 transmits, in step S102, an empty wireless packet in all directions of the intersection, that is, the empty wireless packet is transmitted at a predetermined period.

When the on-board apparatus 20 receives the empty wireless packet from the road-side apparatus 10, the code generating unit 21 of the on-board apparatus 20 generates, in step S103, a code for discriminating the vehicle from other vehicle in response to the received empty wireless packet. The code generated by the code generating unit 21 comprises an identification code of the vehicle (vehicle ID code), a direction code and a path code. As for the vehicle ID code, an ID code unique to each vehicle is used. Alternatively, a sufficiently large number of codes are prepared so that a probability of encounter of vehicles having the same ID code is extremely low. The direction code indicates a direction of movement of the vehicle. The direction code is obtained by encoding an absolute direction which is classified into, for example, sixteen directions by utilizing a car navigation system. The path code indicates a road along which the vehicle is moving. The path code is obtained by encoding each road in previously prepared map data by utilizing the car navigation system.

In step S104, the packet producing unit 22 of the on-board apparatus 20 embeds the above-mentioned codes into a wireless packet, and sends the wireless packet to the transmitting unit 23. In step S105, the transmitting unit 23 of the on-board apparatus 20 transmits the wireless packet received from the packet producing unit 22 to the road-side apparatus 10 as a returning wireless packet.

In the road-side apparatus, it is determined, in step S106, whether or not the wireless packet is received from the on-board apparatus during a predetermined period after the wireless packet is transmitted in step S102. If it is determined that the predetermined period has been passed, the received wireless packet is discarded and the routine returns to step S102 so as to transmit an empty wireless packet at the predetermined period. On the other hand, if it is determined that the wireless packet is received within the predetermined period, the routine proceeds to step S107.

In step S107, the control unit 14 of the road-side apparatus 10 determines whether or not a permission to enter the intersection should be provided to the vehicle which transmitted the received wireless packet. If the receiving unit 13 of the road-side apparatus cannot normally receive the returning wireless packet due to a reason such as a collision of returning wireless packets, a wireless packet for instructing a stop of vehicles entering the intersection is transmitted in each of the directions corresponding to the roads extending from the intersection. Thereafter, the routine returns step S102. On the other hand, if the returning wireless packet is normally received, the a permission for entrance is provided to vehicles in an order of reception of the returning wireless packet when there is no problem occurs in a moving direction of the vehicle. That is, a permission for entrance is provided when there is no jam in the intersection, when there is no vehicle making a right turn or when there is no vehicle entering the intersection earlier from other paths. On the other hand, if there is a problem in a moving direction of the vehicle, a permission is not provided to the vehicle so as to wait for, for example, exit of a vehicle from the intersection.

Then, in step S108, the road-side apparatus 10 transmits a wireless packet in all directions by embedding the vehicle ID code included in the returning wireless packet into the wireless packet to be transmitted when a permission for entrance should be provided to the vehicle which transmitted the returning wireless packet. However, if a permission should not be provided to the vehicle, a different code such as a default code is embedded into the wireless packet to be transmitted, and the wireless packet is transmitted to all directions.

In the on-board apparatus 20, it is determined, in step S109, whether or not the code included in the wireless packet received from the road-side apparatus 10 matches the code previously transmitted by the on-board apparatus 10 itself. If it is determined that the codes match to each other, the routine proceeds to step S110. Otherwise, the routine proceeds to step S111.

In step S110, the control unit 25 of the on-board apparatus 20 provides an instruction to the display unit 26 to display a permission for entering the intersection. Thereby, the driver recognizes a permission of entrance, and drive the vehicle to enter the intersection.

On the other hand, when the routine proceeds to step S111, the control unit 25 of the on-board apparatus 20 provided an instruction to the display unit 26 to display a non-permission for entering the intersection. Thereby, the driver of the vehicle does not drive the vehicle to enter the intersection.

A description will now be given of a second embodiment of the present invention. In the second embodiment, an instruction for permission or non-permission is displayed not on a on-board apparatus but on the road-side apparatus.

Figure 3:
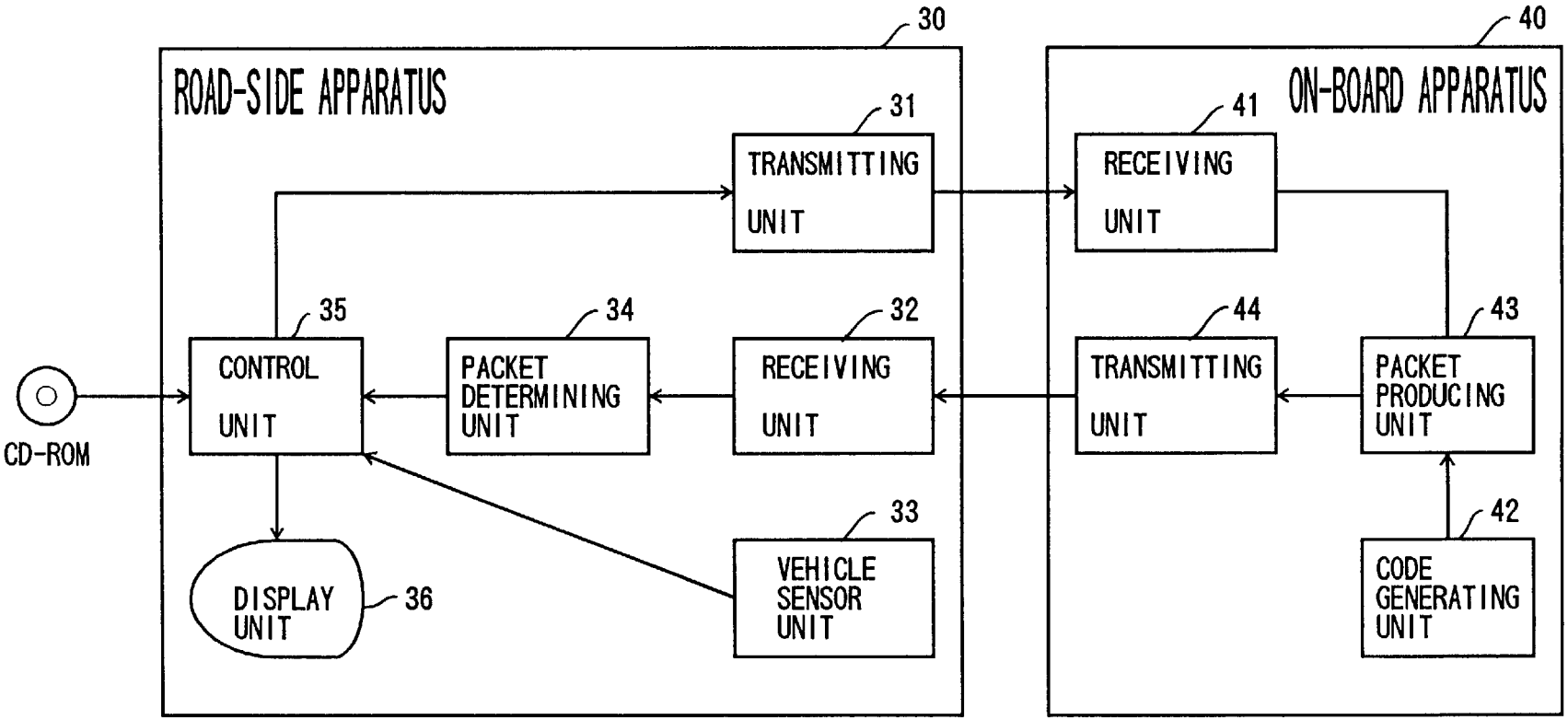
FIG. 3 is a block diagram of an intersection collision avoiding system according to a second embodiment of the present invention.

FIG. 3 is a block diagram of an intersection collision avoiding system according to the second embodiment of the present invention. The intersection collision avoiding system shown in FIG. 3 comprises a road-side apparatus 30 and a on-board apparatus 40. Similar to the road-side apparatus 10 of the first embodiment, the road-side apparatus 20 has a wireless communication function, and is installed at a position where a transmission and a reception of signals can be performed in any direction of an intersection. Similar to the on-board apparatus 20 of the first embodiment, the on-board apparatus 40 is provided on a vehicle, and is communicable with the road-side apparatus 30. A communication system used between the road-side apparatus 30 and the on-board apparatus 40 is the same as that of the first embodiment, and descriptions thereof will be omitted.

The road-side apparatus 30 comprises, as shown in FIG. 3, a transmitting unit 31, a receiving unit 32, an on-board (vehicle) sensor unit 33, a packet determining unit 34, a control unit 35 and a display unit 36. The transmitting unit 31 transmits a wireless packet to the on-board apparatus 40. The receiving unit 32 receives a wireless packet transmitted by the on-board apparatus 40. The on-board sensor unit 33 monitors passage of vehicles in the intersection. The packet determining unit 34 determines an order of reception of returning wireless packets from the on-board apparatus 40 with respect to time. The packet determining unit 34 also determines an occurrence of butting of returning wireless packets transmitted by different vehicles. The control unit 35 controls operations of each units in the road-side apparatus 30. The display unit 36 is installed on the road, and serves as a traffic sign.

The on-board apparatus 40 comprises, as shown in FIG. 3, a receiving unit 41, a code generating unit 42, a packet producing unit 43 and a transmitting unit 44. The receiving unit 41 receives the wireless packet transmitted by the road-side apparatus 30. The code generating unit 42 generates a code which is transmitted to the road-side apparatus 10 by a wireless packet. The packet producing unit 43 produces a wireless packet including the code generated by the code generating unit 42. The transmitting unit 44 transmits the wireless packet produced by the packet producing unit 43.

Figure 4:
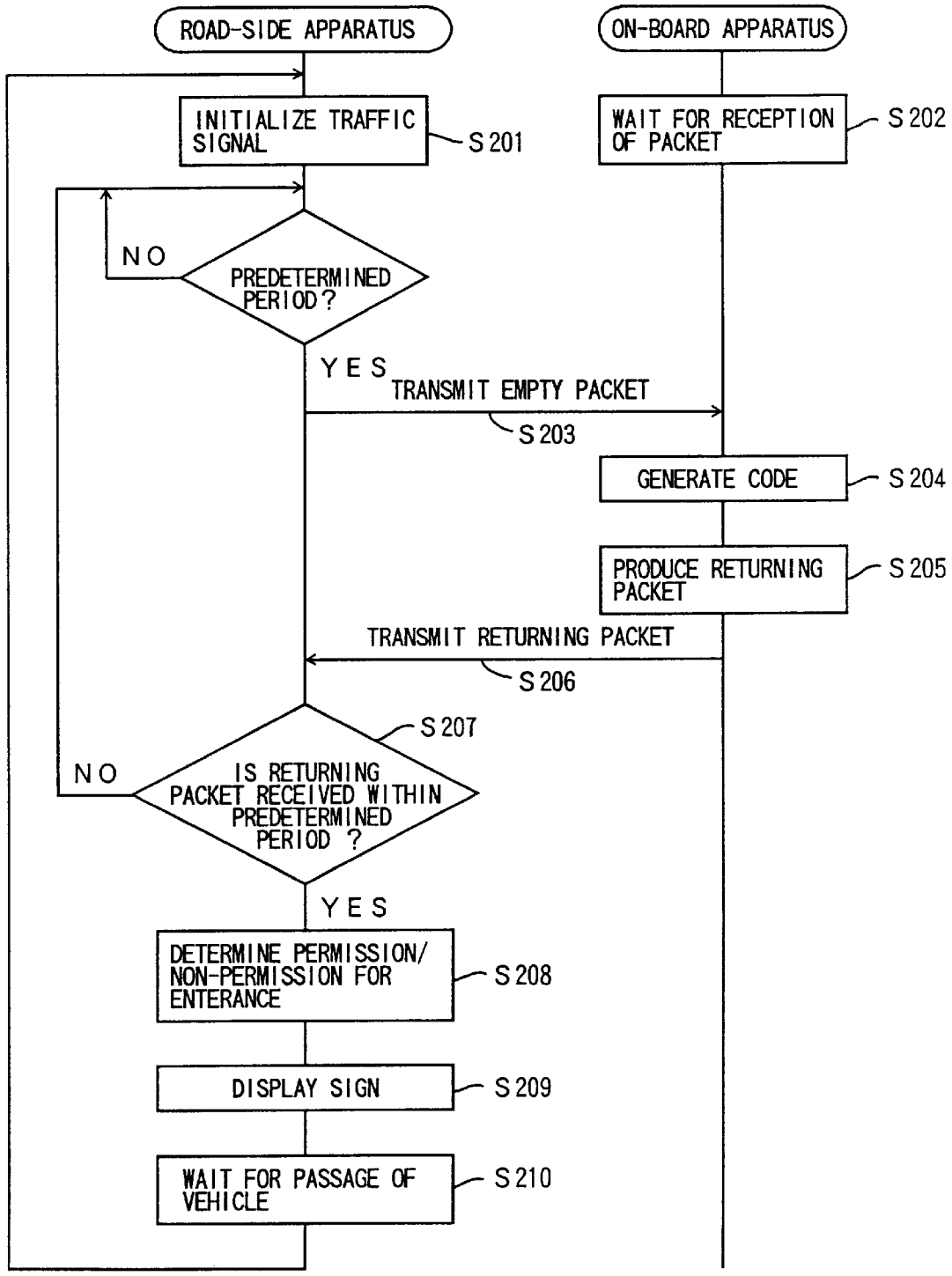
FIG. 4 is a sequence chart of an operation performed by the intersection collision avoiding system shown in FIG. 3.

A description will now be given of an operation of the intersection collision avoiding system according to the second embodiment of the present invention. FIG. 4 is a sequence chart of the operation performed by the intersection collision avoiding system shown in FIG. 3.

In step S201, the display unit 36 of the road-side apparatus 30 is initialized.

In step S202, the on-board apparatus 40 waits for reception of a wireless packet transmitted by the road-side apparatus 30. On the other hand, the road-side apparatus 30 determines whether or not a predetermined period has been passed. If it is determined that the predetermined period has been passed, the road-side apparatus 30 transmits, in step S203, an empty wireless packet in all directions of the intersection, that is, the empty wireless packet is transmitted at a predetermined period.

When the on-board apparatus 40 receives the empty wireless packet from the road-side apparatus 30, the code generating unit 42 of the on-board apparatus 40 generates, in step S204, a code for discriminating the vehicle from other vehicle in response to the received empty wireless packet. The code generated by the code generating unit 42 is the same as the code generated by the code generating unit 21 of the first embodiment, and descriptions thereof will be omitted.

In step S205, the packet producing unit 43 of the on-board apparatus 40 embeds the code generated by the code generating unit 42 into a wireless packet, and sends the wireless packet to the transmitting unit 44. In step S206, the transmitting unit 43 of the on-board apparatus 40 transmits the wireless packet received from the packet producing unit 43 to the road-side apparatus 30 as a returning wireless packet.

In the road-side apparatus 30, it is determined, in step S207, whether or not the returning wireless packet is received from the on-board apparatus during a predetermined period after the wireless packet is transmitted in step S203. If it is determined that the predetermined period has been passed, the received wireless packet is discarded and the routine returns to step S203 so as to transmit an empty wireless packet at the predetermined period. On the other hand, if it is determined that the wireless packet is received within the predetermined period, the routine proceeds to step S208.

In step S208, the control unit 35 of the road-side apparatus 30 determines whether or not a permission to enter the intersection should be provided to the vehicle which transmitted the received returning wireless packet. The determination of the packet determining unit 34 is performed by the same manner as the first embodiment, and description thereof will be omitted.

In step S209, result of the determination of step S208 is displayed on the display unit 36 (traffic sign). If a permission for entrance is provided, a blue light is turned on or a sign such as "ENTER OK". On the other hand, if a permission for entrance cannot be provided, a red light is turned on or a sign such as "DO NOT ENTER" is displayed.

Then in step S210, the vehicle passage sensor 33 of the road-side apparatus 30 monitors passage of the vehicle to which a permission for entering the intersection is provided. After the vehicle passed the intersection, that is, after the vehicle exited the intersection, the routine returns to step S201 to initialize the traffic sign.

A description will now be given of a specific example of an operation achieved by the above-mentioned first and second embodiments of the present invention.

Figure 5:
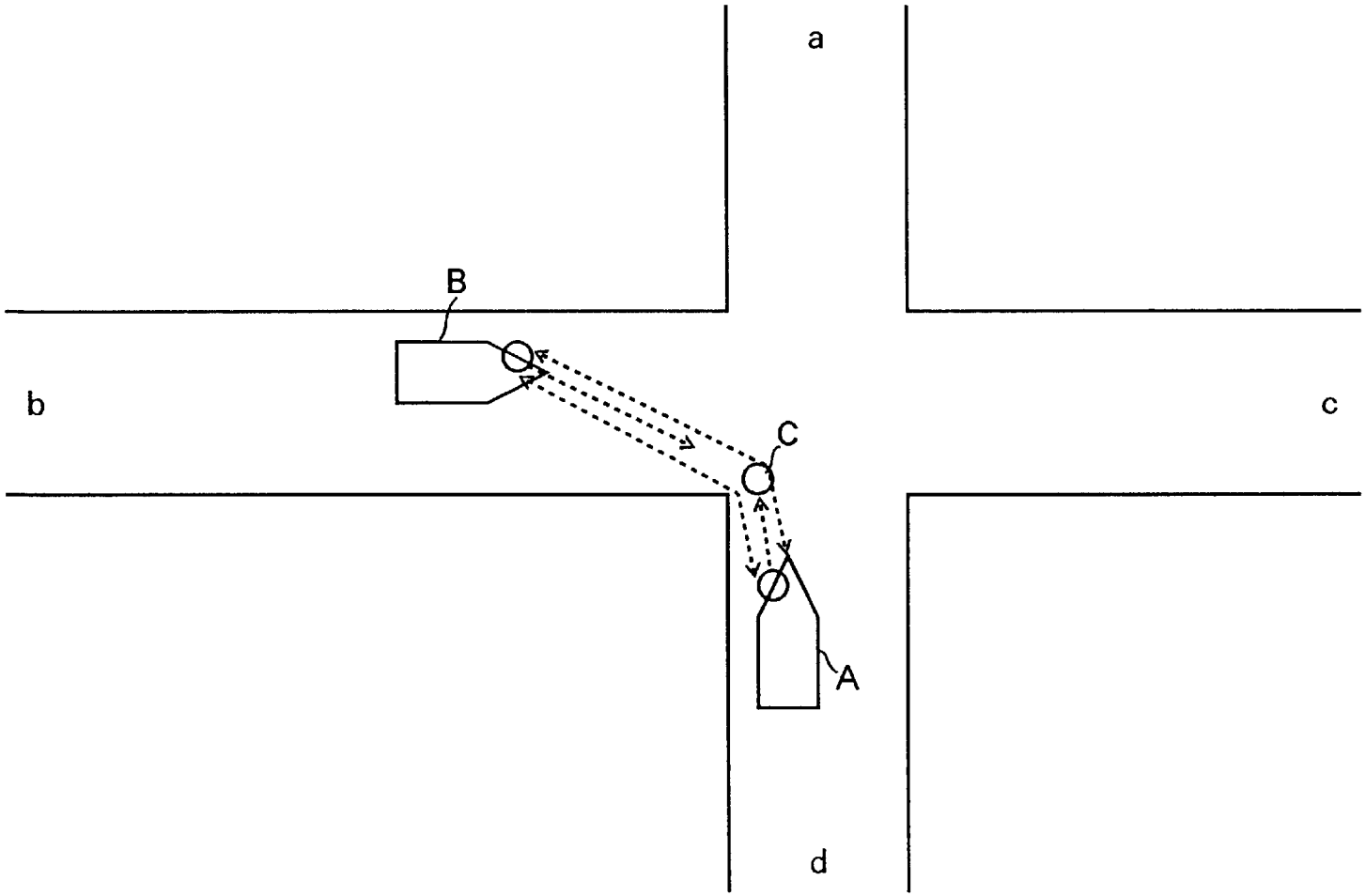
FIG. 5 is an illustration of an operation performed by the first embodiment of the present invention in which an instruction of permission or non-permission is provided to each vehicle via a wireless packet communication.

FIG. 5 is an illustration for explaining an operation performed by the first embodiment of the present invention in which the instruction of permission or non-permission is provided to each vehicle via the wireless packet communication. In FIG. 5, a vehicle A and a vehicle B enter the intersection substantially at the same time. Each of the vehicle A and the vehicle B is provided with the on-board apparatus 20 having the display unit 26 for providing an instruction to a driver. Letters "a", "b", "c" and "d" indicate roads forming the intersection. Letter "C" indicates the road-side apparatus 10.

1) An empty wireless packet is transmitted from the road-side apparatus C at a predetermined time interval.

2) Upon reception of the empty wireless packet, each of the vehicle A and the vehicle B entering the intersection immediately returns the wireless packet to the road-side apparatus C by embedding its own vehicle ID code into the returning wireless packet.

3) The road-side apparatus C receives the returning wireless packet, and then transmits the received wireless packet toward each of the roads "a", "b", "c" and "d". In the example shown in FIG. 5, the empty wireless packet transmitted by the vehicle A reaches the road-side apparatus C first, and does not collide with the empty wireless packet transmitted by the vehicle B.

4) The on-board apparatus of the vehicle A determines that the vehicle ID code of the vehicle A has been returned. Accordingly, a permission for entering the intersection is provided to the driver of the vehicle A by the display unit of the on-board apparatus.

5) The on-board apparatus of the vehicle B determines that the vehicle ID code in the received wireless packet is the one which was transmitted by one of other vehicles. Thus, a non-permission for entering the intersection is provided to the driver off the vehicle B by the display unit of the on-board apparatus.

Figure 6:
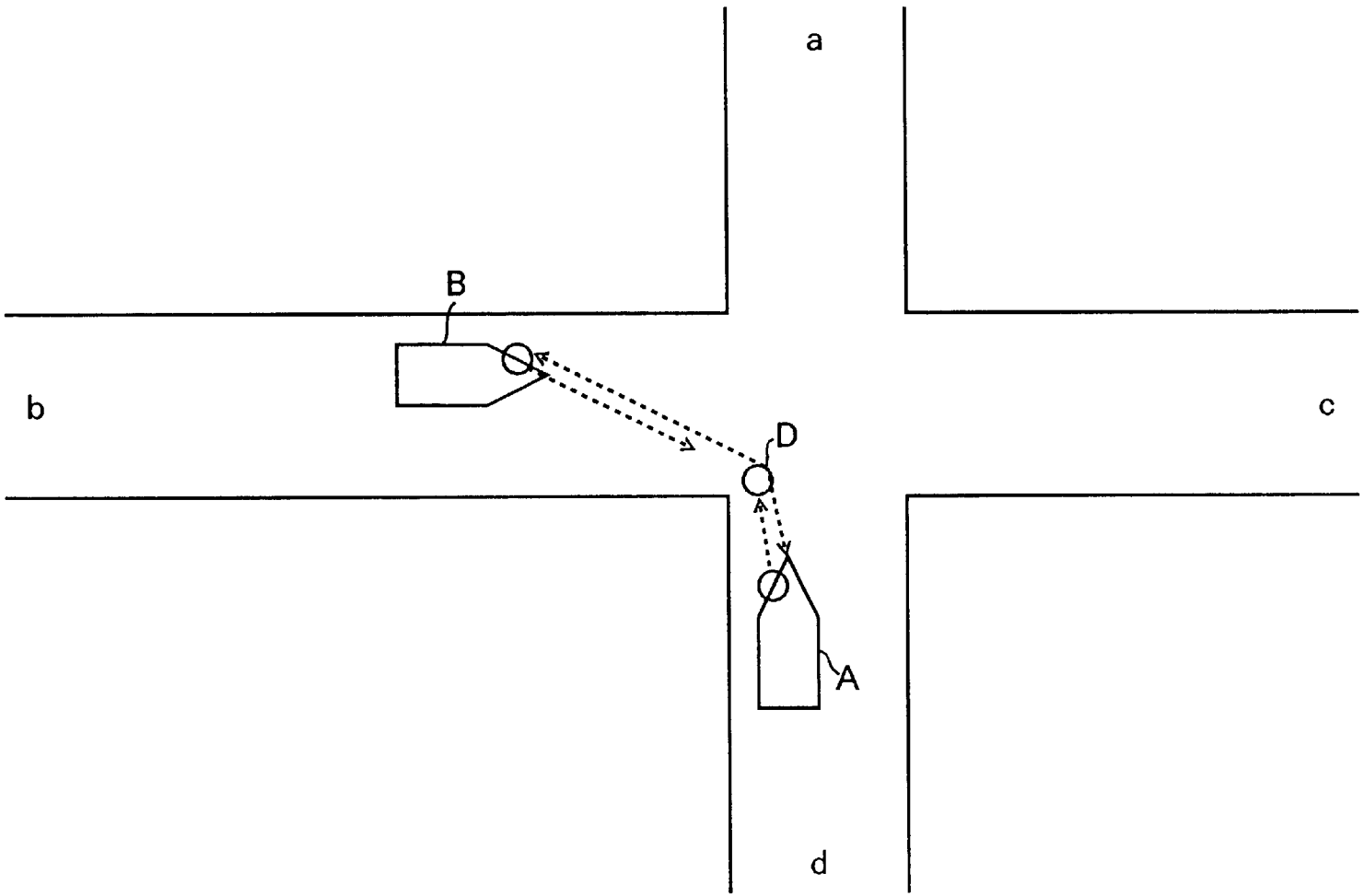
FIG. 6 is an illustration for explaining an operation performed by the second embodiment of the present invention in which an instruction of permission or non-permission is provided to each vehicle via a traffic sign displayed on a display unit of a road-side apparatus.

FIG. 6 is an illustration for explaining an operation performed by the second embodiment of the present invention in which the instruction of permission or non-permission is provided to each vehicle via a traffic sign displayed on the display unit of the road-side apparatus. In FIG. 6, a vehicle A and a vehicle B enter the intersection substantially at the same time. Each of the vehicle A and the vehicle B is provided with the on-board apparatus 30 which merely receives an empty wireless packet and returns the wireless packet by embedding its own vehicle ID code into the wireless packet. Letters "a", "b", "c" and "d" indicate roads forming the intersection. Letter "D" indicates the road-side apparatus 30 having the on-board sensor unit 33 and the display unit 36.

1) An empty wireless packet is transmitted from the road-side apparatus D at a predetermined time interval.

2) Upon reception of the empty wireless packet, each of the vehicle A and the vehicle B entering the intersection immediately returns the wireless packet to the road-side apparatus D by embedding its own vehicle ID code into the returning wireless packet.

3) The road-side apparatus D receives the returning wireless packet, and determines that the vehicle A of which returning wireless packet is received first has a priority to enter the intersection. Thus, the road-side apparatus D displays a traffic sign indicating permission for entering the intersection to the road "d" from which the vehicle A entering the intersection. Additionally, the road-side apparatus D displays a traffic sign, which indicates the non-permission for entering the intersection, toward the rest of the roads "a", "b" and "c".

4) The on-board sensor unit 33 of the road-side apparatus D monitors passage of the vehicle A. After the vehicle exited the procedure of 1) to 3) is repeated.

As mentioned above, according to the first and second embodiments of the present invention, a collision of vehicles at the intersection can be prevented by providing permission for entering the intersection to only one vehicle by utilizing the wireless packet communication between the road-side apparatus and the on-board apparatus.

It should be noted that the operations of the above-mentioned embodiments can be achieved by programs which may be stored in a recording medium such as a disc drive, a memory unit, a floppy disc or a CD-ROM. For example, the control unit 14 shown in FIG. 1 may be provided with a CD-ROM drive so as to read programs stored in a CD-ROM. Similarly, the control unit 35 shown in FIG. 3 may be provided with a CD-ROM drive so as to read programs stored in a CD-ROM.

The present invention is not limited to the specifically disclosed embodiment, and variations and modifications may be made without departing from the scope of the present invention.

The present application is based on Japanese priority application No. 9-335986 filed on Dec. 5, 1997, the entire contents of which are hereby incorporated by reference.

What is claimed is:

1. A method for avoiding a collision at an intersection, the method using a road-side apparatus provided in the intersection and a on-board apparatus provided on a vehicle, said on-board apparatus communicable with said road-side apparatus via a wireless packet communication, said road-side apparatus being located at a position where communications can be performed in any one of directions corresponding to roads extending from the intersection, the method comprising:

periodically transmitting a wireless packet from said road-side apparatus in each of the directions corresponding to the roads extending from the intersection;

receiving said wireless packet by said on-board apparatus and returning said wireless packet from said on-board apparatus to said road-side apparatus as a returning wireless packet by providing a vehicle ID code to said wireless packet, the vehicle ID code being unique to each vehicle;

receiving said returning wireless packet by said road-side apparatus and determining whether said vehicle is to be provided with permission for entering the intersection;

transmitting said returning wireless packet from said road-side apparatus in each of the directions corresponding to the roads extending from the intersection when said vehicle is determined to be provided with permission for entering the intersection;

receiving said returning wireless packet by said on-board apparatus and determining whether or not the vehicle ID code included in said received returning wireless packet matches the vehicle ID code of said vehicle; and providing an instruction of permission for entering the intersection to a driver of said vehicle when the vehicle ID code included in said received returning wireless packet matches the vehicle ID code of said vehicle and providing an instruction of non-permission for entering the intersection to the driver of said vehicle when the vehicle ID code included in said received returning wireless packet is different from the vehicle ID code of said vehicle.

2. The method as claimed in claim 1, further comprising:

eliminating the vehicle ID code from said returning wireless packet prior to being transmitted from said road-side apparatus when said road-side vehicle cannot normally receive said wireless packet returned from said on-board apparatus so that said on-board apparatus determines that permission for entering the intersection is not provided to said vehicle.

3. The method as claimed in claim 1, wherein said providing an instruction includes displaying the instruction on said road-side apparatus.

4. The method as claimed in claim 1, wherein the wireless packet communication between said road-side apparatus and said on-board apparatus is performed in accordance with a spread spectrum communication in a code division multiple access method.

5. An intersection collision avoiding system comprising:

a road-side apparatus provided in an intersection of roads and located at a position where communications can be performed in any one of directions corresponding to the roads; and a on-board apparatus provided on a vehicle, said on-board apparatus communicable with said roadside apparatus via a wireless packet communication, the road-side apparatus communicating with the on-board apparatus for providing traffic command signal to the vehicle to avoid collisions at the intersection, wherein said road-side apparatus comprises a transmitting unit transmitting a wireless packet in each of the directions corresponding to the roads extending from the intersection, and a receiving unit receiving a returning wireless packet transmitted by said on-board apparatus, and said on-board apparatus comprises a packet producing unit producing the returning wireless packet, when the wireless packet transmitted by said road-side apparatus is received, by providing a vehicle ID code to said wireless packet received from said road-side apparatus, the vehicle ID code being unique to each vehicle, a transmitting unit transmitting the returning wireless packet produced by said packet producing unit, and a receiving unit receiving a wireless packet transmitted by said road-side apparatus.

6. The intersection collision avoiding system as claimed in claim 5, wherein said on-board apparatus further comprises:

a control unit for determining whether or not the vehicle ID code included in said returning wireless packet received by said road-side apparatus matches the vehicle ID code of said vehicle; and a display unit providing an instruction of permission for entering the intersection to a driver of said vehicle when the vehicle ID code included in said received returning wireless packet matches the vehicle ID code of said vehicle and providing an instruction of non-permission for entering the intersection to the driver of said vehicle when the vehicle ID code included in said received returning wireless packet is different from the vehicle ID code of said vehicle.

7. The intersection collision avoiding system as claimed in claim 5, wherein said road-side apparatus further comprises:

a packet producing unit producing the wireless packet to be transmitted to said on-board apparatus by eliminating the vehicle ID code from said returning wireless packet when said road-side apparatus cannot normally receive said returning wireless packet so that said on-board apparatus determines that permission for entering the intersection is not provided to said vehicle.

8. The intersection collision avoiding system as claimed in claim 5, wherein said road-side apparatus further comprises:

a control unit determining whether or not said vehicle is to be provided with permission for entering the intersection based on a timing of reception of the returning wireless packet; and a display unit displaying a sign representing the permission for entering the intersection toward one of the roads from which said vehicle is entering the intersection when said vehicle is determined to be provided with the permission, and displaying a sign representing non-permission for entering the intersection toward the rest of the roads.

9. The intersection collision avoiding system as claimed in claim 5, wherein the wireless packet communication between said road-side apparatus and said on-board apparatus is performed in accordance with a spread spectrum communication in a code division multiple access method.

10. A recording medium storing program code for avoiding a collision at an intersection using a road-side apparatus provided in the intersection and a on-board apparatus provided on a vehicle, said on-board apparatus communicable with said road-side apparatus via a wireless packet communication, said road-side apparatus being located at a position where communications can be performed in any one of directions corresponding to roads extending from the intersection, the program code comprising:

program code means for periodically transmitting a wireless packet from said road-side apparatus in each of the directions corresponding to the roads extending from the intersection;

program code means for receiving said wireless packet by said on-board apparatus and returning said wireless packet from said on-board apparatus to said road-side apparatus as a returning wireless packet by providing a vehicle ID code to said wireless packet, the vehicle ID code being unique to each vehicle;

program code means for receiving said returning wireless packet by said road-side apparatus and determining whether said vehicle is to be provided with permission for entering the intersection;

program code means for transmitting said returning wireless packet from said road-side apparatus to each of the directions corresponding to the roads extending from the intersection when said vehicle is determined to be provided with permission for entering the intersection;

program code means for receiving said returning wireless packet by said on-board apparatus and determining whether or not the vehicle ID code included in said received returning wireless packet matches the vehicle ID code of said vehicle; and program code means for providing an instruction of permission for entering the intersection to a driver of said vehicle when the vehicle ID code included in said received returning wireless packet matches the vehicle ID code of said vehicle and providing an instruction of non-permission for entering the intersection to the driver of said vehicle when the vehicle ID code included in said received returning wireless packet is different from the vehicle ID code of said vehicle.

11. The recording medium as claimed in claim 10, wherein the program code further comprises:

program code means for eliminating the vehicle ID code from said returning wireless packet prior to transmission from said road-side apparatus when said road-side vehicle cannot normally receive said wireless packet returned from said on-board apparatus so that said on-board apparatus determines that permission for entering the intersection is not provided to said vehicle.

12. The recording medium as claimed in claim 11, wherein the program code means for providing an instruction includes program code means for displaying the instruction on said road-side apparatus.

13. An apparatus for avoiding a collision at an intersection of a plurality of paths, said apparatus comprising:

receiving means for receiving data from a plurality of vehicles moving along said plurality of path; and permission notification means for sending a wireless signal to each of the plurality of vehicles, the on-board receiver of each vehicle based upon said received data from said vehicles receiving an on-board wireless signal and determining from the received wireless signal whether the respective vehicle has permission or non-permission to enter the intersection.

14. A method of avoiding collisions between automobiles entering an intersection of roads traveled by the automobiles, the menthod comprising:

approaching an intersection by a plurality of automobiles; and automatically controlling traffic at the intersection by a roadside controller via wireless communication between the roadside controller and each of the plurality of automobiles, wherein each automobile transmits a wireless signal to the roadside controller and, in response, the roadside controller transmits a wireless signal to each automobile indicating whether the respective automobile has permission or does not have permission to enter the intersection based upon the received signals from said automobiles by said roadside controller.

15. A method of avoiding collisions between land-based vehicles entering an intersection of roads traveled by the vehicles, the method comprising:

automatically transmitting a wireless signal from each of the vehicles to an intersection controller controlling traffic at the intersection; and automatically transmitting a wireless signal from the intersection controller to each of the vehicles to indicate whether the respective vehicle has permission or not to enter the intersection based upon receipt of the wireless signals from said vehicles by the intersection controller.

16. A method as in claim 15, further comprising, for each vehicle:

in accordance with the wireless signal transmitted from the intersection controller to the respective vehicle, displaying for a driver of the vehicle whether the vehicle has permission to enter the intersection.

17. A method as in claim 15, wherein the wireless signal transmitted from each vehicle to the intersection controller includes a vehicle identifier to distinguish the vehicle from other vehicles, and the wireless signal transmitted from the intersection controller to each vehicle includes the vehicle identifier of a respective vehicle provided with permission to enter the intersection.

18. A method as in claim 17, further comprising for each vehicle:

in accordance with the wireless signal transmitted from the intersection controller to the respective vehicle, displaying for a driver of the vehicle whether the vehicle has permission to enter the intersection.

19. A method as in claim 17, further comprising, for each vehicle:

receiving, by the respective vehicle, the wireless signal transmitted from the intersection controller;

comparing the vehicle identifier in the wireless signal transmitted from the intersection controller with the vehicle identifier of the respective vehicle, to determine whether the respective vehicle has permission to enter the intersection.

20. A method of controlling traffic at an intersection by an intersection controller, the method comprising:

wirelessly transmitting packets from the intersection controller to vehicles approaching the intersection;

after receipt of a respective packet by a respective vehicle, including a vehicle identifier by said respective vehicle in the packet, the vehicle identifier distinguishing said respective vehicle from other vehicles;

wireless transmitting the packet having the vehicle identifier from said respective vehicle to the intersection controller;

after receipt of the packet by the intersection controller, wirelessly retransmitting the packet having the vehicle identifier to vehicles approaching the intersection to control traffic in the intersection.

21. A method as in claim 20, further comprising:

receiving the retransmitted packet by said respective vehicle; and displaying for a driver of said respective vehicle that the vehicle has permission to enter the intersection.

22. A method as in claim 20, wherein each of the vehicles approaching the intersection has a corresponding vehicle identifier to distinguish the vehicle from other vehicles, the method further comprising:

receiving the retransmitted packet by vehicles approaching the intersection; and for each of the vehicles receiving the packet and having a vehical identifier different from that included in the retransmitted packet, displaying for the driver of a vehical that the vehical does not have permission to enter the intersection.

23. A method as in claim 22, further comprising:

receiving the retransmitted packet by said respective vehicle having the vehicle identifier matching the vehicle identifier in the retransmitted packet; and displaying for a driver of said respective vehicle that the vehicle has permission to enter the intersection.

24. A method of controlling traffic at an intersection by an intersection controller, comprising:

wirelessly transmitting packets from the intersection controller to vehicles approaching the intersection;

for each vehicle, after receipt of a respective packet, including a vehicle identifier in the received packet, the vehicle identifier distinguishing the vehicle from other vehicles, and wireless transmitting the packet having the vehicle identifier from the vehicle to the intersection controller; and after receipt of the packets from the vehicles by the intersection controller, wirelessly retransmitting the packets having the vehicle identifiers to the vehicles, to control traffic in the intersection.

25. A method as in claim 24, wherein each vehicle waits to enter the intersection until receiving a retransmitted packet from the intersection controller having the vehicle identifier of the vehicle.

26. A method as in claim 24, further comprising:

for each vehicle, when the vehicle receives a retransmitted packet from the intersection controller having the vehicle identifier of the vehicle, displaying for a driver of the vehicle that the vehicle has permission to enter the intersection.

27. A method as in claim 24, further comprising:

for each vehicle, when the vehicle receives a retransmitted packet from the intersection controller which does not have the vehicle identifier of the vehicle, displaying for a driver of the vehicle that the vehicle does not have permission to enter the intersection.

28. A method as in claim 24, further comprising:

controlling traffic in the intersection in accordance with an order of receipt of the packets from the vehicles by the intersection controller.

29. An apparatus for avoiding collisions between land-based vehicles entering an intersection of roads traveled by the vehicles, the apparatus comprising:

means for automatically transmitting a wireless signal from each of the vehicles to an intersection controller controlling traffic at the intersection; and means, after receipt of the wireless signals by the intersection controller, for automatically transmitting a wireless signal from the intersection controller to each of the vehicles to indicate whether the respective vehicle has permission to enter the intersection.

* * * * *

UNITED STATES PATENT AND TRADEMARK OFFICE

CERTIFICATE OF CORRECTION

PATENT NO.: 6,049,295
DATED : April 11, 2000
INVENTOR(S): Jun SATO

It is certified that error appears in the above-identified patent and that said Letters Patent is hereby corrected as shown below:

Col. 14, line 4, change "path" to --paths--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*